US006769327B2

(12) United States Patent
Henry

(10) Patent No.: US 6,769,327 B2
(45) Date of Patent: Aug. 3, 2004

(54) KNIFE AND BLADE SHARPENER

(75) Inventor: Mark James Henry, West End (AU)

(73) Assignee: Furitechnics Pty Ltd., West End (AU)

( * ) Notice: Subject to any disclaimer, the term of this patent is extended or adjusted under 35 U.S.C. 154(b) by 0 days.

(21) Appl. No.: 10/273,199

(22) Filed: Oct. 17, 2002

(65) Prior Publication Data

US 2003/0075022 A1 Apr. 24, 2003

(30) Foreign Application Priority Data

Oct. 18, 2001 (AU) ..... PR8346
Feb. 12, 2002 (AU) ..... PS0456

(51) Int. Cl.[7] ..... B24B 3/54
(52) U.S. Cl. ..... 76/86; 76/82
(58) Field of Search ..... 76/82, 84, 86, 76/82.2, 83

(56) References Cited

U.S. PATENT DOCUMENTS 2,413,156 A 12/1946 Tarapczynski
2,509,636 A 5/1950 Goldstein
4,751,795 A 6/1988 Jeanne
5,440,953 A * 8/1995 Gangelhoff et al. ..... 76/86

FOREIGN PATENT DOCUMENTS

| | | |
|---|---|---|
| EP | 02445135 | 8/2003 |
| FR | 2556638 | 6/1985 |
| GB | 517242 | 1/1940 |

* cited by examiner

*Primary Examiner*—Douglas D. Watts
(74) *Attorney, Agent, or Firm*—Epstein Drangel Bazerman & James, LLP

(57) ABSTRACT

A knife sharpener (10) has pairs of overlapping, resiliently flexible fingers or strips (21–23, 31–33) to form opposed sharpening faces (27–29, 37–39) operable to engage at least one cutting edge (101) on a knife blade (102). The sharpening faces (27–29, 37–39) can have abrasive materials and/or surfaces (40–43) to generate the desired finish on the cutting edge(s) (101).

17 Claims, 4 Drawing Sheets

KNIFE AND BLADE SHARPENER

BACKGROUND OF THE INVENTION

1. Field of the Invention

THIS INVENTION relates to a knife sharpener.

Throughout the specification, the term "knife" shall include cutting devices and utensils of the type having a handle or grip; at least one cutting blade, which may be fixed, foldable or partially or wholly retractable relative to the handle or grip; the or each cutting blade having at least one cutting edge.

Examples of the cutting devices and utensils included within the term "knife" shall include kitchen knives, butcher's knives, chef's knives, sporting knives, box cutters or so-called "Stanley" (Trade Mark) knives, pocket knives, letter openers or bodkins, and the like.

2. Prior Art

Traditionally, knives such as butcher's knives and chef's knives were sharpened or honed using a honing steel and/or whetstone. However, as many people did not have the necessary skill to use such steels to produce good cutting edges on their knives, many different types of knife sharpeners have been developed over the years. While these knife sharpeners are easier to use for the average person, they generally have one or more practical limitations and so there is still a quest to develop an improved knife sharpener.

SUMMARY OF THE PRESENT INVENTION

It is an object of the present invention to provide a knife sharpener, which is easy to use without the necessity for special skills and which preferably provides a cutting edge which is similar to that produced by a honing steel.

It is a preferred object of the present invention to provide such a knife sharpener, which is relatively simple to manufacture and which may be relatively inexpensive to manufacture.

It is a further preferred object of the present invention to provide a knife sharpener, which can easily be varied in specification to suit the particular knives, which it is intended to sharpen.

It is a still further preferred object to provide such a knife sharpener, which may be freestanding; or which may be incorporated into a knife scabbard or knife block, or affixed to any solid or support surface.

Other preferred objects of the present invention will become apparent from the following description.

In one aspect the present invention resides in a knife sharpener including:

at least one pair of overlapping, resiliently flexible, fingers or strips mountable in and/or on a base; and abrasive means on at least one portion of Inwardly directed, opposed, sharpening faces on the fingers or strips, operable to engage at least one cutting edge on a blade of a knife (as hereinbefore defined).

The base may be freestanding eg., to rest on a bench, or be mounted on a wall, and may be provided with a handle which preferably extends laterally to a sharpening axis of the sharpener. Alternatively, the base may include, or be incorporated in, a knife scabbard or knife block. Where the base is a knife scabbard or knife block, preferably the fingers or strips extend Into a hole, aperture, slot, or groove in the scabbard or block, or are mounted on a side of the scabbard or block.

Preferably there are two or more pairs of the resiliently flexible fingers or strips provided in the overlapping arrangement.

Preferably one of the, or each pair of fingers is formed integrally with a mounting plate or bracket mountable in or on the base; and the other of the, or each pair of fingers is formed integrally with a second plate or bracket.

Preferably the fingers or strips are offset relative to the plane of the mounting brackets or plates and are curved or angled relative thereto in side view.

The fingers or strips may be formed from resilient material including metals and their alloys; polymeric materials; composite materials; elastomeric materials and/or a combination of two or more of these and the materials may be reinforced eg., with metal fibres, plastic fibres, carbon fibres, or other suitable materials.

The abrasive means may include abrasive material and/or abrasive surfaces.

The abrasive materials may include sapphires and other hard gems, diamond dust or crushings; manufactured abrasives, including diamond-like carbon and carborundum; natural abrasives eg., stone; hard metal alloys, such as WC, CrC, VC; hard ceramics and their composites; and/or a combination of two or more of these. The selection of the particular abrasive material(s) and the grit sizes may be varied to suit the particular composition of the steels/alloys of the blades and the desired finish of the cutting edges.

The abrasive surfaces may be mechanically treated surfaces, such as grooves, knurling, random pitting or shot-blasting, or may be smooth, unmolested surfaces. The mechanically-treated surfaces may be similar to hard-chrome or hardened carbon steels, which may be coated with a hard surface (eg., hard chromed), hard or soft platings, or uncoated. Smooth surfaces are particularly suitable for fine honing of the cutting edges.

BRIEF DFSCRIPTION OF THE DRAWINGS

To enable the invention to be fully understood, preferred embodiments will now be described with reference to the accompanying drawings in which.

DETAILED DESCRIPTION OF THE PREFERRED EMBODIMENTS

Figure 1:
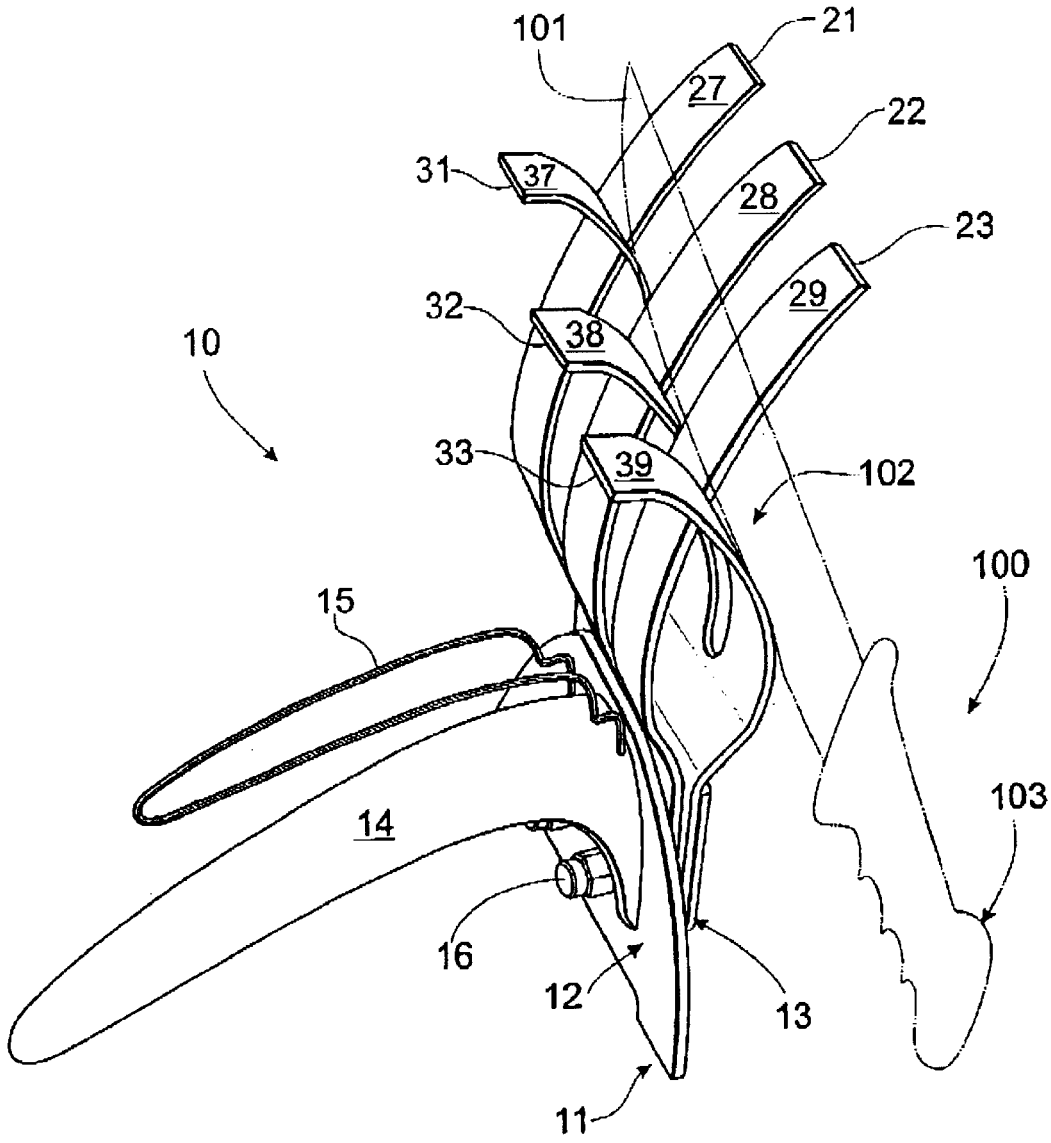
FIG. 1 is a schematic, perspective view of a first embodiment of a knife sharpener in accordance with the present invention.

Referring to FIG. 1, the knife sharpener 10 of a first preferred embodiment of the present invention, to be hereinafter described, is designed to provide a sharp cutting edge 101 to the blade 102 of a knife 100 having a handle 103.

The sharpener 10 has a body 11 with a body flange 12 and optional backing plate 13 which may be bolted or fastened together by suitable bolts or fasteners 16.

A handle 14 is attached to, or formed integrally with, the body so flange 12, and extends substantially at right angles to the sharpening axis of the knife sharpener 10 (along which knife 100 is shown to extend). A finger guard 15, of any suitable shape, overlies the handle 14 so that the handle 14 is squeezed by the user's hand/fingers and the guard 15 protects the hand/fingers against downward, accidental movement, of the knife blade 102.

Figure 2:
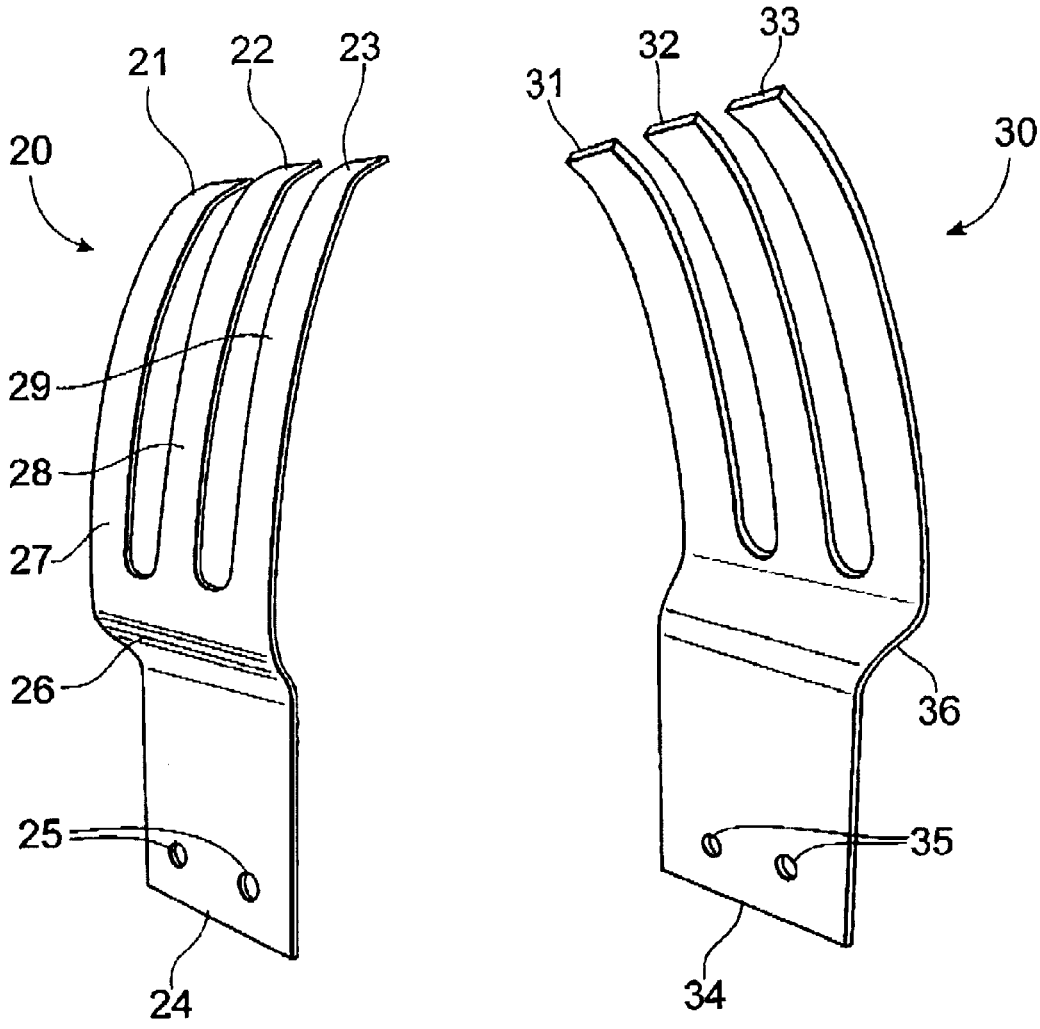
FIGS. 2 and 3 are perspective views of the fingers and associated mounting plates suitable for the embodiment of FIG. 1.
Figure 3:
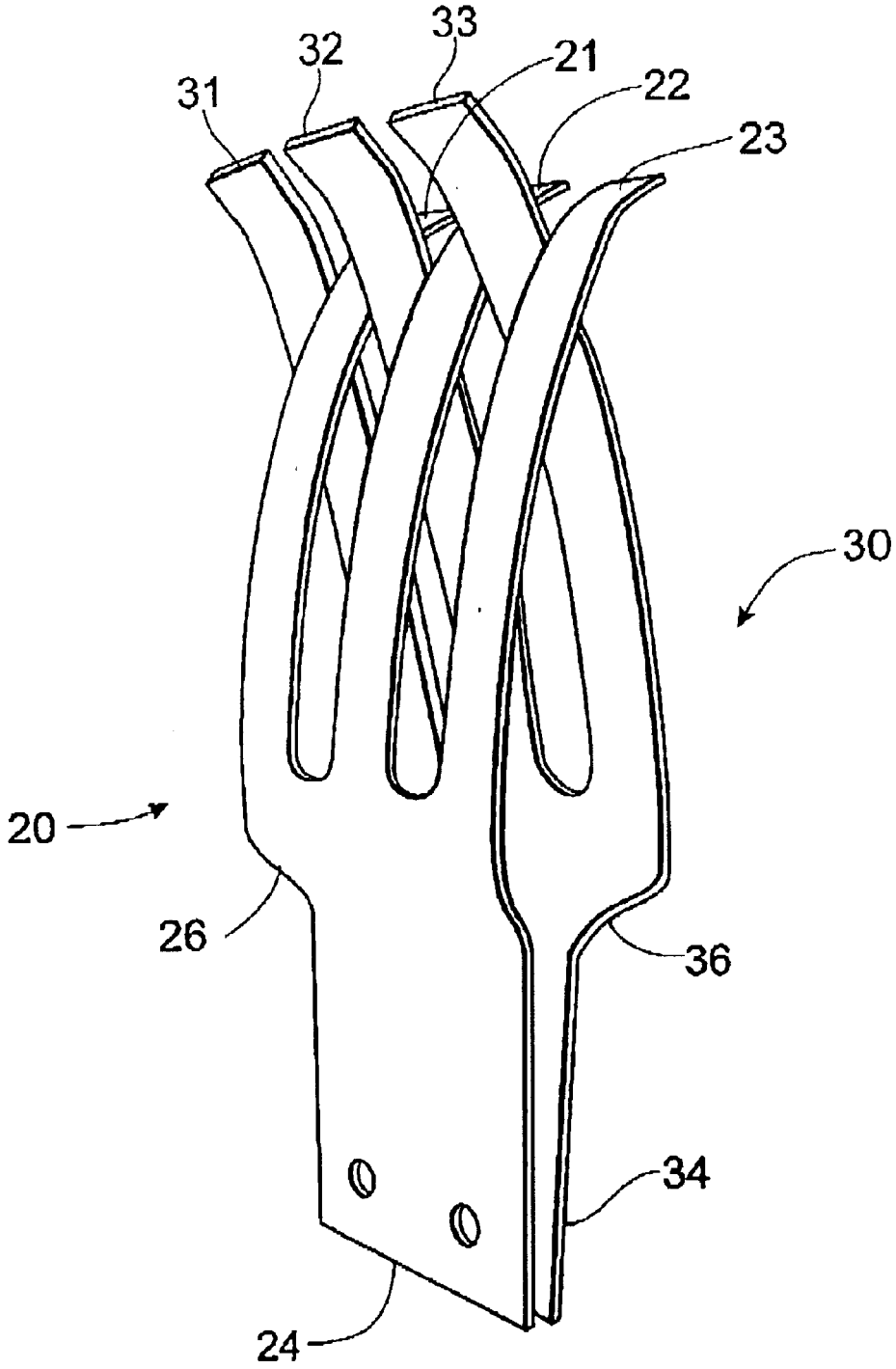

As shown more clearly in FIGS. 2 and 3, a pair of sharpening members 20,30 are clamped to the body flange 12 so that the respective fingers 21–23 and 31–33 are arranged in an overlapping relationship shown in FIGS. 1 and 3.

In the specific embodiment illustrated, the sharpening members 20,30 are formed eg., by cutting and pressing from sheet metal. Each sharpening member 20,30 has a mounting plate 24,34 with holes 25,35 to allow the fasteners 16 to pass therethrough. The fingers 21–23 and 31–33 are curved and are outwardly offset relative to the mounting plates 24,34 and are connected thereto by substantially S-shaped intermediate sections 26,36, so that the lower portions of the fingers 21–3, 31–33 are spaced, and the fingers then overlap to form opposed sharpening faces 27–29 and 37–39 respectively.

Figure 6:
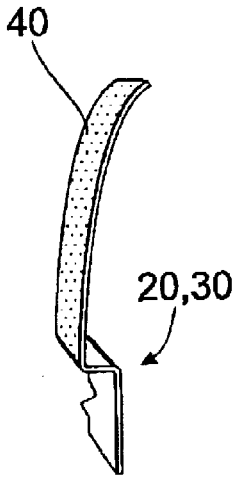
FIGS. 6 to 9 are perspective views of alternative abrasive surfaces on the fingers or strips.

Abrasive material 40 eg., fine diamond dust (see FIG. 6) is applied to the sharpening faces 27–29, 37–39, eg., by suitable adhesive or coating or plating means.

The operation of the sharpener will now be described with reference to FIG. 1.

The knife blade 101 is placed in the "valley" formed by the overlapping fingers 21–23, 31–33 so that the cutting edge 101 engages the sharpening faces 27–29, 37–39. As the knife 100 is pulled away from the sharpener 10, or pushed towards it, preferably with at least some downward pressure, the abrasive material on the sharpening faces 27–29, 37–39 grinds, or abrades, the cutting edge 101 to improve the quality of the cutting edge 101.

The blade 102 may be passed between the opposed fingers 21–23, 31–33 one or more times until the desired quality of cutting edge 101 is achieved.

Figure 7:
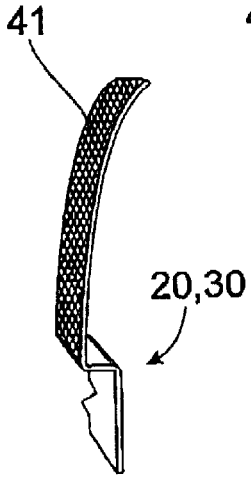
Figure 8:
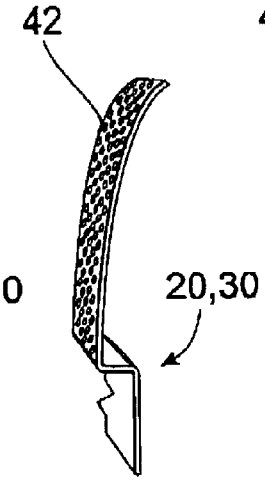

In alternative embodiments, the sharpening faces 27–29, 37–39 can be mechanically treated to provide an abrasive surface that is non-abrasive particle based. The mechanically treated surfaces can incorporate grooves or knurling 41, random-pitting 42, a shot-blasted, eg., in the nature of standard hard-chromed or hardened carbon steels—see FIGS. 7 and 8.

In a further alternative embodiment, the sharpening faces 27–29, 37–39 can have smooth, unmolested surfaces, eg., for fine honing of the cutting edges.

Figure 9:
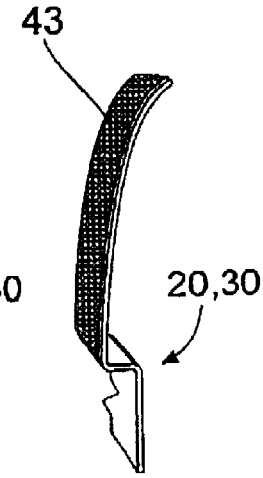

The abrasive surfaces may be coated 43, eg,. with hard-chrome, hard or soft plating materials (see FIG. 9); or may be left unplated (eg., bare metal).

In a still further alternative embodiment, aftemative sharpening faces 27–29, 37–39 may have abrasive materials and abrasive surfaces respectively; or the sharpening faces 27–29, 37–39 may have both abrasive materials and abrasive surfaces.

As the fingers 21–23, 31–33 are resiliently flexible, they can accommodate different blade thicknesses, cutting edge profiles and/or degree of downward pressure applied to the knife blade 102.

It will be readily apparent to the skilled addressee that the number of pairs of fingers; the curvature and angle and offset of the fingers; the construction of the fingers (eg., metal/metal alloys/fibre reinforced plastics); grit of the sharpening faces; type of abrasive material(s)/surface(s); width size of the abrasive material(s)/surface(s); and other desired details may be varied to suit the particular intended application, or manufacturing expediency.

Where the fingers are formed from plastics, composites and/or elastomeric materials, they may be moulded to shape and may incorporate fibre reinforcing materials (eg., metal fibres, glass fibres, carbon fibres).

Figure 4:
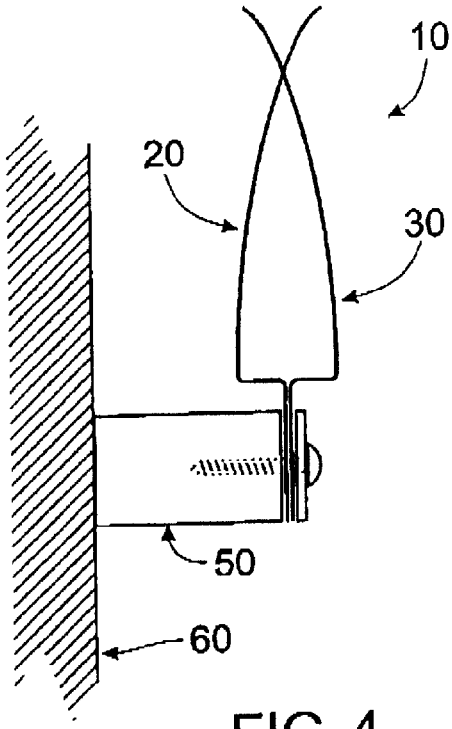
FIG. 4 is an end elevational view of a second embodiment.
Figure 5:
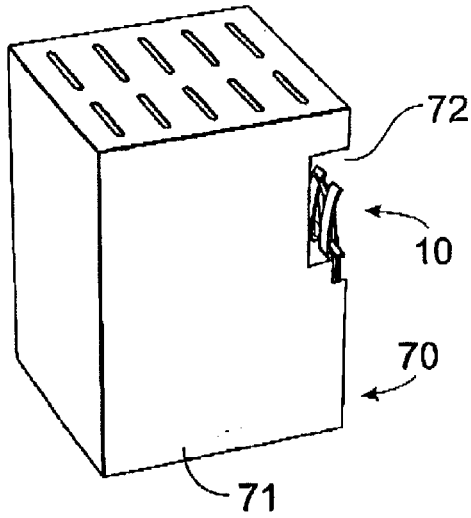
FIG. 5 is a perspective view of a third embodiment.

It will be readily apparent to the skilled addressee that the knife sharpener 10 may be free standing, eg., to be used on a bench; or may be mounted eg., on a suitable support or bracket 50 on a wall or workbench 60, as shown in FIG. 4.

The knife sharpener 10 may also be provided in a knife scabbard or knife block 70, where the sharpening members 20,30 are mounted within the body 71 of the scabbard or block; and the fingers 21–23, 31–33 extend Into a hole, aperture, groove or slot 72 within, or on, the body 71 of the scabbard or block 70.

It will be readily apparent to the skilled addressee that various other changes and modifications may be made to the embodiments described and illustrated without departing from the present invention.

What is claimed is:

1. A knife sharpener including:

at least one pair of overlapping, resiliently flexible, fingers or strips mountable in and/or on a base;

abrasive means on at least one portion of inwardly directed, opposed, sharpening faces on the fingers or strips, operable to engage at least one cutting edge on a blade of a knife; and a handle attached to the base and at a right angle to a blade of a knife being sharpened.

2. A knife sharpener including:

at least one pair of overlapping, resiliently flexible, fingers or strips mountable in and/or on a base; and abrasive means on at least one portion of inwardly directed, opposed, sharpening faces on the fingers or strips, operable to engage at least one cutting edge on a blade of a knife the base is a knife scabbard or knife block, and the fingers or strips extend into a hole, aperture, slot, or groove in the scabbard or block, or are mounted on a side of the scabbard or block.

3. A sharpener as claimed in any one of claims 1 or 2, wherein:

there are two or more pairs of the resilient flexible fingers or strips provided in the overlapping arrangement.

4. A sharpener as claimed in claim 3, wherein:

one of the or each pair of fingers is formed integrally with a mounting plate or bracket mountable in or on the base; and the other of the or each pair of fingers is formed integrally with a second plate or bracket.

5. A sharpener as claimed in claim 4, wherein:

the fingers or strips are offset relative to the plane of the mounting brackets or plates and are curved or angled relative thereto in side view.

6. A sharpener as claimed in any one of claims 1 or 2, wherein:

the fingers or strips may be formed from resilient material including metals and their alloys; polymeric materials; composite materials; elastomeric materials and/or a combination or two or more of these, and the materials are optionally reinforced with metal fibers, plastic fibers, carbon fibers, or other suitable materials.

7. A sharpener as claimed in any one of claims 1 or 2, wherein:

the abrasive means includes abrasive material and/or abrasive surfaces.

8. A sharpener as claimed in claim 7, wherein:

the abrasive materials include sapphires and other hand gems; diamond dust or crushings; manufactured abrasives, including diamond-like carbon and Carborundum; natural abrasives, including stone; hard metal alloys, including WC, CrC, VC; hard ceramics and their composites; and/or a combination of two or more of these, the selection of the particular abrasive material (s) and the grit sizes being varied to suit the particular composition of the steels/alloys of the blades and the desire finish of the cutting edges.

9. A sharpener as claimed in claim 7, wherein:

the abrasive surfaces are mechanically treated surfaces, including grooves, knurling, random pitting or shot-blasting, or are smooth, unmolested surfaces.

10. A sharpener as claimed in claim 9, wherein:

the mechanically-treated surfaces are similar to hard-chromed or hardened carbon steels; optionally coated with a hard surface including hard chrome, hard or soft platings; or uncoated.

11. A sharpener as claimed in claim 1 having a guard located above the handle and below the resilient fingers.

12. A knife sharpener including:

two or more of overlapping, resilient flexible, fingers or strips;

each strip having a sharpening face which is flat across the width of the finger;

abrasive means on at least one portion of inwardly directed, opposed, sharpening faces on the fingers or strips, operable to engage at least one cutting edge on a blade of a knife;

each pair of fingers being formed integrally with a mounting plate or bracket; the other of each pair of fingers is formed integrally with a second plate or bracket; and the fingers or strips being offset relative to the plane of the mounting brackets or plates and curved relative thereto in side view.

13. A sharpener as claimed in claim 12, wherein:

the fingers or strips may be formed from resilient material including metals and their alloys; polymeric materials; composite materials; elastomeric materials and/or a combination or two or more of these, and the materials are optionally reinforced with metal fibers, plastic fibers, carbon fibers, or other suitable materials.

14. A sharpener as claimed in the claim 12, wherein:

the abrasive means includes abrasive material and/or abrasive surfaces.

15. A sharpener as claimed in claim 13, wherein:

the abrasive materials include sapphires and other hand gems; diamond dust or crushing; manufactured abrasives, including diamond-like carbon and carborundum; natural abrasives, including stone; hard metal alloys, including WC, CrC, VC; hard ceramics and their composites; and/or a combination of two or more of these, the selection of the particular abrasive material (s) and the grit sizes being varied to suit the particular composition of the steels/alloys of the blades and the desire finish of the cutting edges.

16. A sharpener as claimed in claim 13, wherein:

The abrasive surfaces are mechanically treated surfaces, including grooves, knurling, random pitting or shot-blasting, or are smooth, unmolested surfaces.

17. A sharpener as claimed in claim 15, wherein:

the mechanically-treated surfaces are similar to hard-chromed or hardened carbon steels; optionally coated with a hard surface including hard chrome, hard or soft platings; or uncoated.

* * * * *